United States Patent [19]

Semmler

[11] Patent Number: 4,641,321

[45] Date of Patent: Feb. 3, 1987

[54] COOLED FURNACE HEAD FOR HEAVY-CURRENT RESISTANCE FURNACES

[75] Inventor: Jürgen Semmler, Donauwörth, Fed. Rep. of Germany

[73] Assignee: Sigri GmbH, Augsburg, Fed. Rep. of Germany

[21] Appl. No.: 757,630

[22] Filed: Jul. 22, 1985

[30] Foreign Application Priority Data

Jul. 25, 1984 [DE] Fed. Rep. of Germany ..... 3427407

[51] Int. Cl.[4] ..... H05B 3/00; H05B 3/60

[52] U.S. Cl. ..... 373/120; 373/125

[58] Field of Search ..... 373/120–126, 373/113, 114, 119

[56] References Cited

U.S. PATENT DOCUMENTS

| | | | |
|---|---|---|---|
| 1,029,121 | 6/1912 | Heroult | 373/114 |
| 1,533,269 | 4/1925 | Reid | 373/114 |
| 1,572,893 | 2/1926 | Little | 373/114 |
| 2,908,738 | 10/1959 | Rough | 373/36 |
| 4,015,068 | 3/1977 | Vohler | 373/120 |
| 4,477,911 | 10/1984 | Racki | 373/36 |

*Primary Examiner*—Roy N. Envall, Jr.

*Attorney, Agent, or Firm*—Herbert L. Lerner; Laurence A. Greenberg

[57] ABSTRACT

Furnace head for heavy-current resistance furnaces of refractory masonry and at least one cooled electrode inserted into the masonry. Cooling devices extending over the entire length of the electrode are inserted into the latter and the temperature of the electrode can be set by controlling the cooling to the temperature of the masonry.

11 Claims, 4 Drawing Figures

1
2
3
4
5
6
7
13
14'
14"
II

COOLED FURNACE HEAD FOR HEAVY-CURRENT RESISTANCE FURNACES

BACKGROUND OF THE INVENTION

1. Field of the Invention

The invention relates to a furnace head for a heavy-current resistance furnace of refractory masonry and at least one cooled electrode inserted into the masonry.

2. Description of the Prior Art

Heavy-current resistance furnaces are furnaces, in which the charge stacked between the electrodes is heated to temperatures of 2000° C. and above through the direct passage of current at high current intensities. Typical representatives of this type are furnaces for graphitizing carbon products which furnaces generally consist of a rectangular furnace bed equipped with granular refractory materials, furnace heads at the end faces and movable side walls. In the Acheson graphitizing furnace, the material to be graphitized is stacked alternatingly with layers of a granular resistor compound between the furnace heads. Also the stack is surrounded by granular insulating material. The heating to the graphitizing temperature of about 3000 K. is accomplished by resistance heating; the electric current is fed to the stack of charge material via the electrodes of graphite inserted into the furnace heads. With increasing temperature, the charge expands uniformly initially, but in steps with the start of the liberation of the sulfur contained in the carbon, and the volume of the charge then decreases with the increasing degree of crystalline order or graphitizing. Volume changes are taken up substantially by the granular resistor material, the packing density of which is changed accordingly so that no major forces released by volume changes of the charge attack at the electrodes. Nevertheless, gaps are formed between the masonary and the electrode, due especially to the different thermal coefficients of expansion and the temperature difference between the masonry and the electrode.

In the graphitizing furnace first proposed by Castner which is often called a longitudinal graphitizing furnace, the material to be graphitized, for instance, in the form of cylindrical carbon bodies is clamped without intermediate layers of granular resistor material between the graphite electrodes of the furnace heads. At least one electrode is movable in the direction of the longitudinal axis of the furnace and is pressed against the strand which rests against the counter-electrode and is formed as a rule of several carbon bodies, for setting a low contact resistance. The length change of the strand in the graphitizing process which in the heating-up phase amounts to about +0.5 to 1 percent and in the cooling-down phase of the furnace about −1 to 1.5 percent is intercepted by the shift of the electrode in the direction of the longitudinal axis of the furnace and opposite to the movement of the strand. A prerequisite for the mobility of the electrode relative to the masonry of the furnace head is sufficient clearance, between the electrode and the masonry.

The parts of the electrodes protruding from the masonry on the side of the furnace head facing away from the furnace are as a rule cooled. In small furnaces, the coolant is sprayed directly on the electrode surface, but in general, cooling plates or cooling staves are used, through which coolants flow. This procedure enables recovery of part of the stored energy as heat in the cooling-down phase of the furnaces. However, the temperature of the electrode is below the critical reaction temperature in only a small area, such that the larger part of the electrode which is not cooled to below the reaction temperature reacts with the air oxygen entering into the furnace through gaps between the masonry and the electrode. As a result of the reaction of the electrode with the air oxygen, the width of the gaps and the rate of burnoff increase and finally, the electrode must be replaced. The detrimental formation of gaps is further promoted by the temperature differences between the masonry and the electrode, due to the differences in thermal conductivity and the generation of Joule heat.

SUMMARY OF THE INVENTION

An object of the invention is to retard or prevent rapid destruction of the electrodes in the furnace heads of high-current resistance furnaces by chemical reactions and to extend the service life of the electrodes substantially. Another object of the invention is to provide improved means for the recovery of heat from the heavy-current resistance furnace with more energy obtained at a higher temperature.

With the foregoing and other objects in view, there is provided in accordance with the invention a furnace head for heavy-current resistance furnaces of refractory masonry, at least one cooled electrode inserted into the masonry, at least one cooling device inserted in the electrode and extending the length of the electrode, and means for controlling cooling of the electrode to obtain an electrode temperature which is about the same temperature as the masonry.

Other features which are considered as characteristic for the invention are set forth in the appended claims.

Although the invention is illustrated and described herein as embodied in a cooled furnace head for heavy-current resistance furnaces, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DESCRIPTION OF THE PREFERRED EMBODIMENT

Figure 1:
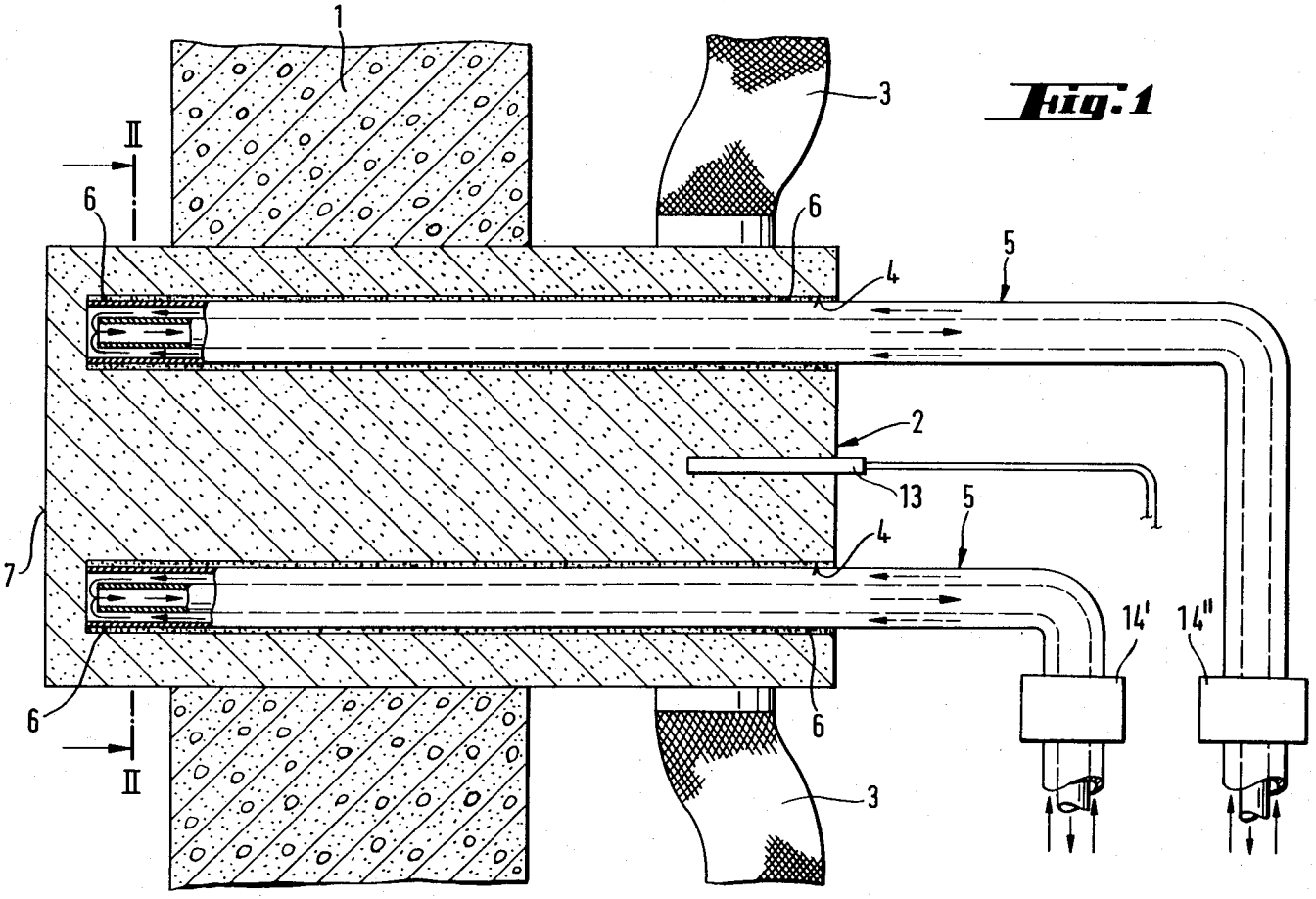
FIG. 1 diagrammatically illustrates a longitudinal section of a furnace head in accordance with the invention in which a graphite electrode is inserted into the refractory masonry of the furnace head. Double-jacket tubes for cooling the graphite electrode are inserted in holes in the electrodes. A layer of graphite and copper powder is disposed between the outer wall of the tube and the electrode to provide good thermal conductivity between the electrode and the wall.

The problem of gaps between the masonry and the electrode is solved with a furnace head of the type mentioned at the outset by the provision that cooling devices extending over the entire length of the electrode are inserted into the latter and the temperature of the electrode can be set to the temperature of the masonry by controlling the cooling. The invention is based on the insight that the surface life of the electrode is extended substantially if the effective cooling of the electrode extends over the entire volume and correspondingly the entire surface. In order to suppress the development of gaps between the masonry and the electrode, it is essential here to control the coolant flow to bring the temperature of the electrode to about the same temperature as the masonry, i.e. the temperatures of the electrode and of the masonry are about equal. This purpose of temperature equalization is accomplished by means of temperature sensors arranged in the electrode and the masonry, together with at least one control valve in the coolant feed which is acted upon by the temperature difference as the controlled variable. Temperature sensors are well-known devices as, for example, thermocouples and resistance thermometers, and similarly control valves are well-known devices as, for example, diaphragm valves and ball valves. The electrodes which have a cylindrical or a slab shape, consist of graphite, a temperature-resistant metallic material, for instance, molybdenum or tungsten, or a core of a metal with high electric and thermal conductivity and cover plates of a temperature-resistant material such as graphite which shield the core at least against the contents of the furnace. The cooling devices do not extend into the cover plates. In electrodes without cover plates, the cooling elements are not brought into the head area of the electrode on the furnace side. A zone free of cooling elements with a thickness of several centimeters is provided for mechanical and thermal protection of the cooling elements.

The cooling devices consist of simple, preferably finned metal tubes and advantageously of double-jacket tubes which are inserted into holes in the electrode. The gap or clearance between the cooling tube and the wall of the hole is advantageously filled with a heat conductor in powder form, preferably a mixture of copper and graphite powders to effect lowering the heat resistance between the cooling tube and the wall of the hole.

In a preferred embodiment of the invention, the cooling device is a heat pipe. The heat pipe is either placed in a hole of the electrode and the heat resistance between these parts is lowered by a heat conductor in powder form, or the heat pipe rests directly against the refractory masonry of the furnace head. The hot front end of the heat pipe is provided in this embodiment with a protective cap of graphite extending into the heavy current resistance furnace. The other end of the heat pipe is associated with a heat exchanger or part of a heat exchanger by contact therewith for the extraction of heat from the end of the heat pipe.

Heat pipes are known per se. They consist of a tightly closed container with a filling forming a capillary system, for instance, woven fabrics, braids, sintered material and the like. The capillaries contain as the heat carrier a small amount of liquid. If a temperature difference exists between the two ends of the heat pipe, the liquid at the hot end evaporates. The vapor produced by the evaporation flows toward the cold end of the heat pipe, is condensed, and the condensate flows toward the hot end under the action of the capillary forces. The effective heat conductivity of a heat pipe is several times the conductivity of copper. Isothermal surface temperatures, uniform temperatures, are also of advantage in the invention. The preferred operating medium for the heat pipe is water which is advantageously used as the coolant in the other cooling devices.

Another advantage of the heat pipe is that the wall of the heat pipe can be used as the conductor for the current that must be fed to the graphitizing furnace. For this purpose, the outer end of the heat pipe is bolted to bus bars, current-carrying cables or the like. The wall thickness of the heat pipe is designed such that at the maximum operating current of the heavy-current resistance furnace, no substantial intrinsic heating by Joule heat takes place. A wall thickness of about 20 mm is generally sufficient for heat pipes of low-alloy steel. To lower the electric resistance of the wall of the heat pipe, it is advantageous to make at least part of the wall of a highly conductive metal such as copper. In this embodiment, two tubes are telescoped concentrically; the outer tube consists, for instance, of steel and the inner tube of copper. A protective cap of graphite which shields the heat pipe thermally is screwed or cemented onto the front end of the heat pipe.

The number of cooling pipes or heat pipes inserted into the electrode is determined by the thermal stress of the furnace head. The cooling capacity must be sufficient to cool the surface area of the electrode such that it does not exceed the critical reaction temperature of the electrode material which temperature for a graphite electrode is about 500° C.; and also provide sufficient cooling that the electrode temperature does not deviate substantially from the temperature of the masonry, desirably the temperature does not deviate more than ten percent. Under these conditions there is practically no oxidative wear of the electrode. The large cooling capacity also facilitates the recovery and utilization of the heat stored in the furnace as well as recovery and utilization of heat in the cooling phase of the operation.

The invention will be explained in the following by way of an example, with the aid of schematic drawings.

Figure 2:
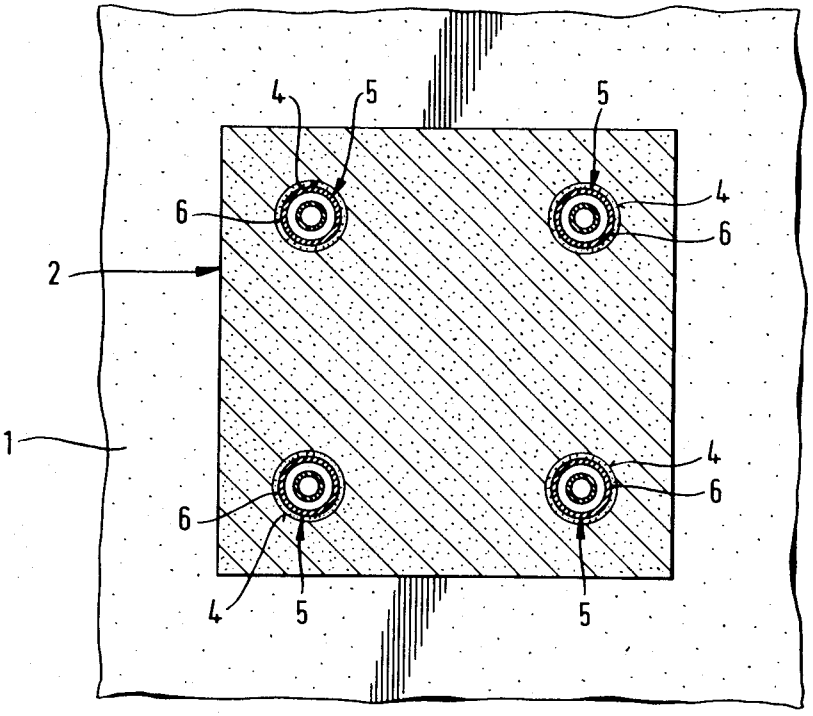
FIG. 2 is a section of the furnace head taken along line II—II of FIG. 1.

In FIGS. 1 and 2, an electrode 2 of graphite, to which the heating current is fed via flexible cables 3, is inserted into the refractory masonry 1 of the furnace head. The electrode 2 is provided with holes 4 into which double-jacket tubes 5 are inserted. The tubes extend almost to the end face 7 of the electrode so that the temperature can be set substantially constant over the total volume of the electrode. Thermal resistance between the tube 5 and the electrode 2 is reduced by filling the annular gap therebetween with a layer 6 of graphite and copper powder. A temperature sensor 13 is inserted into the electrode 2 and the measured temperature is used to control the coolant feed by valves 14' and 14''. The coolant feed flow is indicated by arrows.

Figure 3:
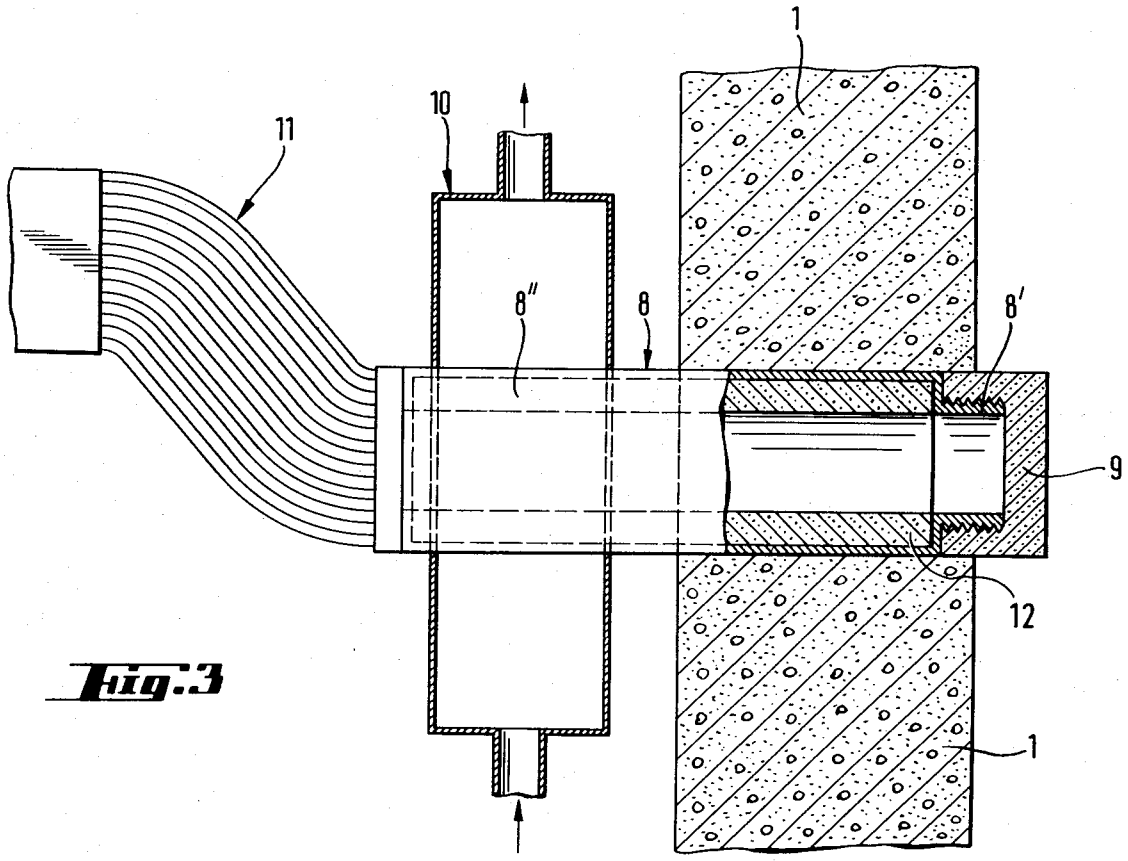
FIG. 3 illustrates a furnace head in which a heat pipe is inserted as an electrode into the masonry of the furnace head. A graphite cap covers the hot end of the heat pipe. A heat exchanger extracts heat from the cold end of the heat pipe.
Figure 4:
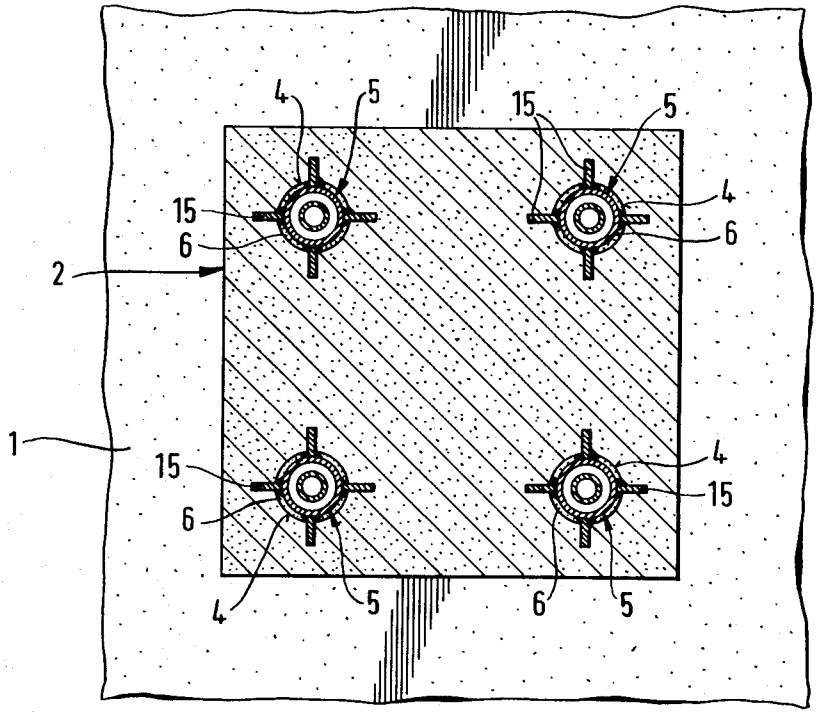
FIG. 4 is a section of the furnace head similar to that of FIG. 2 but differing therefrom particularly in the use of finned tubes.

In FIG. 3 the heat pipe 8 is inserted as an electrode into the masonry 1 of the furnace head, and the graphite cap 9 is screwed on its hot end 8' and the capillary structure 12 in which the heat transferring liquid is moved extends between its hot end 8' and its cold and 8''. The heat exchanger rests against the cold end 8'' of the heat pipe 8. The current is fed-in via flexible copper ribbons 11. The coolant flow through heat exchanger 10 is indicated by arrows and the amount of coolant is controlled via temperature sensors and valves, not shown graphically. In FIG. 4, the same section is shown as in FIG. 2 but with finned tubes 15.

The foregoing is a description corresponding, in substance, to German application No. P 34 27 497.3, dated July 25, 1984, International priority of which is being claimed for the instant application, and which is hereby made part of this application. Any material discrepancies between the foregoing specification and the specification of the aforementioned corresponding German application are to be resolved in favor of the latter.

There is claimed:

1. Furnace head for heavy-current resistance furnaces of refractory masonry, at least one electrode inserted into the masonry, at least one cooling device inserted in the electrode and extending almost the full length of the electrode but stopping short of the end thereof, and means for controlling cooling of the electrode to obtain an electrode temperature which is about the same temperature as the masonry.

2. Furnace head according to claim 1, wherein the cooling device is a finned tube.

3. Furnace head according to claim 1, wherein the cooling device is a double-jacket tube.

4. Furnace head according to claim 1, wherein a gap is provided between the cooling tube and the electrode and wherein the gap is filled with a mixture of copper and graphite powder.

5. Furnace head according to claim 2, wherein a gap is provided between the cooling tube and the electrode and wherein the gap is filled with a mixture of copper and graphite powder.

6. Furnace head according to claim 3, wherein a gap is provided between the cooling tube and the electrode and wherein the gap is filled with a mixture of copper and graphite powder.

7. Furnace head according to claim 1, wherein the electrode contains a heat pipe as the cooling device.

8. Furnace head according to claim 7, wherein a gap is provided between the heat pipe and the electrode and wherein the gap is filled with a mixture of copper and graphite powder.

9. Furnace head for heavy-current resistance furnaces of refractory masonry having at least one electrode comprising a heat pipe inserted into the masonry in contact with the refractory masonry of the furnace and the front end of the heat pipe covered by a protective cap of graphite which extends into the furnace.

10. Furnace according to claim 1, wherein the cooling device is a conductor for the heating current of the furnace.

11. Furnace according to claim 9, wherein the heat pipe is a conductor for the heating current of the furnace.

* * * * *